US009241578B1

(12) United States Patent
Franken

(10) Patent No.: US 9,241,578 B1
(45) Date of Patent: Jan. 26, 2016

(54) UNDER MATTRESS SUPPORT

(71) Applicant: Colleen M. Franken, Plantation, FL (US)

(72) Inventor: Colleen M. Franken, Plantation, FL (US)

( * ) Notice: Subject to any disclaimer, the term of this patent is extended or adjusted under 35 U.S.C. 154(b) by 0 days.

(21) Appl. No.: 14/170,776

(22) Filed: Feb. 3, 2014

Related U.S. Application Data

(63) Continuation-in-part of application No. 13/758,045, filed on Feb. 4, 2013, now abandoned.

(51) Int. Cl.

| | |
|---|---|
| ***A47C 21/06*** | (2006.01) |
| ***A47C 20/02*** | (2006.01) |
| ***A47C 27/08*** | (2006.01) |
| ***A47C 31/12*** | (2006.01) |

(52) U.S. Cl.
CPC ..... *A47C 21/06* (2013.01); *A47C 20/027* (2013.01); *A47C 27/087* (2013.01); *A47C 31/123* (2013.01)

(58) Field of Classification Search
CPC .... A47C 21/06; A47C 19/027; A47C 20/027; A47C 27/20; A47C 19/025; A47C 23/00; A47C 27/087; A47C 31/123; A47C 27/001; A61G 2007/0518; A47B 23/02; A47G 9/062
USPC ..... 5/695, 236.1, 240, 417, 420
See application file for complete search history.

(56) References Cited

U.S. PATENT DOCUMENTS

| | | | | | |
|---|---|---|---|---|---|
| 194,831 | A | * | 9/1877 | Stweard | 5/420 |
| 1,334,745 | A | * | 3/1920 | Farr | 53/438 |
| 2,490,867 | A | * | 12/1949 | Greenhill | 5/659 |
| 2,551,976 | A | | 5/1951 | Smith | |
| 2,595,111 | A | * | 4/1952 | Steward | 52/582.1 |
| 2,616,100 | A | * | 11/1952 | Weiner | 5/236.1 |
| 2,638,606 | A | * | 5/1953 | Austin | 5/239 |
| 2,847,685 | A | * | 8/1958 | Freedlander | 5/659 |
| 3,280,515 | A | * | 10/1966 | Eriksson | 5/659 |
| 3,319,274 | A | * | 5/1967 | Upton | 5/701 |
| 3,751,742 | A | * | 8/1973 | Worley | 5/659 |
| 3,882,559 | A | * | 5/1975 | Kano | 5/499 |
| 4,399,574 | A | | 8/1983 | Shuman | |
| 4,476,594 | A | * | 10/1984 | McLeod | 5/701 |
| 4,644,596 | A | * | 2/1987 | Husler | 5/236.1 |
| 4,671,393 | A | | 6/1987 | Rainey | |
| 4,745,645 | A | * | 5/1988 | McWilliams | 5/659 |
| 4,815,155 | A | * | 3/1989 | Sommers | 5/659 |
| 4,878,258 | A | * | 11/1989 | Casey | 5/420 |
| 4,908,887 | A | * | 3/1990 | Shaw, Jr. | 5/419 |
| 4,955,665 | A | * | 9/1990 | Richer | 297/4 |
| 5,048,167 | A | * | 9/1991 | Heffley et al. | 29/91.1 |
| 5,066,001 | A | * | 11/1991 | Wilkinson | 482/52 |

(Continued)

*Primary Examiner* — Nicholas Polito
*Assistant Examiner* — David R Hare
(74) *Attorney, Agent, or Firm* — Glenn E. Gold; Gold & Rizvi, P.A.

(57) ABSTRACT

An under mattress support to extend the longevity of an existing mattress that may include areas that are concave resulting in sag areas or soft areas comprising a plurality of heavy duty elongated polyurethane foam slats, enclosed in top and bottom pliable fabric covers that are stitched together along each slat lateral side but spaced apart by pliable fabric strips in a parallel slat array. The fabric strip spacing of the parallel foam slats allows for lateral compression to enhance support. The under mattress support is positioned below the mattress and above a box spring with the elongated polyurethane foam slats extended longitudinally from a portion of one side of the mattress to a portion of the other side of the mattress where the concave portion of a sagging or soft mattress appears in the normal course of use.

12 Claims, 6 Drawing Sheets

(56) References Cited

U.S. PATENT DOCUMENTS

| | | | | |
|---|---|---|---|---|
| 5,170,521 | A | 12/1992 | Light | |
| 5,448,789 | A * | 9/1995 | Shirai | 5/613 |
| 5,669,089 | A * | 9/1997 | Dees | 5/419 |
| 5,739,472 | A * | 4/1998 | Buck et al. | 174/107 |
| 5,950,260 | A * | 9/1999 | Dees | 5/420 |
| 5,970,549 | A * | 10/1999 | Rudden | 5/713 |
| 6,199,232 | B1 * | 3/2001 | Kocivar | 5/502 |
| 6,618,883 | B2 * | 9/2003 | Angland | 5/659 |
| 6,711,762 | B2 * | 3/2004 | Olenick et al. | 5/118 |
| 6,871,369 | B1 * | 3/2005 | Long | 5/659 |
| 7,036,162 | B1 * | 5/2006 | Gatten | 5/421 |
| 7,350,772 | B2 * | 4/2008 | Legrand | 256/25 |
| 8,651,579 | B2 * | 2/2014 | Pettingill et al. | 297/452.56 |
| 2003/0101515 | A1 * | 6/2003 | Gordon | 5/659 |
| 2005/0172412 | A1 * | 8/2005 | Pearson | 5/659 |
| 2006/0117486 | A1 * | 6/2006 | Clark et al. | 5/659 |

* cited by examiner

UNDER MATTRESS SUPPORT

CROSS REFERENCE TO RELATED APPLICATIONS

This application is a continuation-in-part of co-pending U.S. patent application Ser. No. 13/758,045 filed Feb. 4, 2013.

BACKGROUND OF THE INVENTION

1. Field of the Invention

This invention relates in general to a mattress support that is positioned under a mattress and on top of a box spring, and specifically to an under mattress support for mattresses to restore the support integrity in a sagging or softer well-used mattress.

2. Description of Related Art

Mattresses over periods of extended use tend to develop areas of sag that may develop a concave center or side area, or become too soft, greatly reducing body support and sleeping comfort. The mattress is not unusable but is uncomfortable. It would be desirable to have a device that could extend the useful life and support of such a mattress. Discarding such a used mattress can be costly thereby requiring a new mattress replacement prematurely.

Typical solutions in the past have been unsatisfactory such as placing plywood sheets or hard plastic, metal, or wooden slats between the mattress and box spring. This often results in an unnaturally stiff or hard mattress which is not comfortable for sleeping thereby not satisfactorily solving the problem of mattress sag based on extended use.

A portable mattress stiffener is disclosed in U.S. Pat. No. 4,815,155 issued Mar. 28, 1989. The portable supplemental support disclosed which is placed between the mattress and the box springs, includes a plurality of rigid slats, which are inherently stiff, resulting in an uncomfortable mattress support that is different in structure and functionality. An individually adjustable additional bottom for beds is disclosed in U.S. Pat. No. 3,280,515, issued Oct. 25, 1966, that includes a pad having pockets that receive steel or fiberglass rods or stays. This device also is very rigid in its support and uncomfortable. Unpatented online sales disclose multiple chamber air support systems to provide lift to a sagging mattress. It is believed that the support provided by individual air chambers is not sufficient to lift and restore a sagging mattress to a comfortable disposition. These air chambers merely displace or move around the air from underneath the individual to alongside the individual while at the same time creating a hardened bulge and requiring ongoing maintenance. Other non-patented devices that are being sold over the Internet are flat, plastic interlocking pieces. Some devices include foldable cardboard pieces, and some devices sit atop a mattress and are made of steel rods or other hard materials, which do not provide a comfortable support.

The problem being addressed herein is not one of providing an orthopedic solution for people with extreme back problems by over supporting or hardening the mattress surface.

The invention described herein is to enhance an existing softer or well-used mattress so that the mattress continues to provide comfort and support for normal persons for sleeping and at the same time extending the useful life of the current mattress and restoring the mattress to the original shape and comfort.

With the use of the invention described herein, which is an under mattress support, the use and wear of any mattress can be extended to continue to provide comfort and support for one or more individuals while sleeping and reducing the expense of replacing the existing mattress that has sags or concave pockets and deformities based on extended use. The under mattress support described herein is positioned under a mattress and on a top of its accompanying box spring.

SUMMARY OF THE INVENTION

An under mattress support for extending the use of a sagging mattress comprising a plurality of substantially rectangular and parallel slats, each slat being made of heavy duty polyurethane foam. Each slat can vary in width between 2.5 inches and 8 inches, and vary in height between 1 inch and 4 inches deep. The slat length is determined by mattress size. The invention also raises up the height of a sagging or soft mattress to restore its original configuration.

In one embodiment, a bottom cover made of pliable cloth or fabric such as a cotton backing is fastened to each of said slats, affixing said slats in a flat plane parallel to each other and spaced apart laterally approximately 2-5 inches. A top cover is fastened to said bottom cover and to said parallel foam slats. Said top cover is may be made of a pliable material such as quilters batting to reduce slippage when the top cover is in contact with a mattress surface. The entire device can be portable and rolled up.

In another embodiment the heavy duty polyurethane foam slats are rectangular polyhedrons encased in a parallel array by sewing together top and bottom pliable fabric covers that provide for a fixed, parallelly-spaced relationship of approximately 2-5 inches between the lateral sides of each of the foam slats accomplished by sewing the top and bottom covers together along seams adjacent each lateral side of an encased foam slat. The defined fixed pliable fabric strip or band spacing between each of the parallel foam slats is very important to the operation of the mattress support in distributing the weight loading between the upper mattress and the lower box spring that encompass the mattress support. The longitudinal ends of each of the foam slats are also encompassed by sewing together the top and bottom covers. Thus each foam slat in the mattress support is completely encased in a fabric cover by sewing together the top and bottom covers completely around each foam slat and at the same time providing fixed lateral fabric strips spacing with the joined fabric covers, top and bottom, for fixing the separation between parallel slats. Throughout the specification, references are made to foam slats, parallel foam slats, and parallelly-spaced apart foam slats, all of which references the parallel, elongated, heavy duty polyurethane foam slats used in the invention.

The under mattress support is positioned beneath the mattress that is sagging and on top of the box spring positioned below the mattress. The parallel foam slats are also positioned to be parallel to the top and bottom edges of the mattress. Therefore the parallel foam slats are positioned between the mattress and the box spring such that the parallel spaced-apart slats extend in length from a portion of one side of the mattress to be supported to a portion of the other side of the mattress to engage concave sections in the mattress. Because the foam slats are made of heavy duty polyurethane foam and are resilient while at the same time being spaced apart to allow some displacement of the mattress surface, the slats provide overall support to the mattress to restore the original configuration and to uplift a sagging mattress, especially where the mattress has a central or side concave area caused by extended use.

The parallel resilient foam slats and their configuration of being spaced apart in a defined and fixed parallel array provide comfortable support to a user in areas of the mattress that have been deformed from longtime use. The separations between each of the polyurethane foam slats allow for breathing room and lateral displacement of the under mattress support slats between the mattress and box spring to prevent pressure points and to provide a more supportive surface area. The under mattress support also bolsters the height of the mattress to make the bed and elevated mattress appear to be in a newer condition extending the life of the mattress. Because of the defined air spacing between the slats, it is believed that heating between the mattress and the box spring will be reduced. The foam slats, the bottom cloth cover, and the top cloth cover joined together at each slat lateral side provide fixed lateral spacing, holding the slats in a parallel array laterally that can be rolled up for transport or storage.

It is an object of this invention to provide an under mattress support to restore a comfortable support and shape to a mattress that has extended use including softness and sagging based on use for a long period of time thereby alleviating necessity of purchasing a new mattress.

DETAILED DESCRIPTION THAT IS OF THE INVENTION

Figure 1:
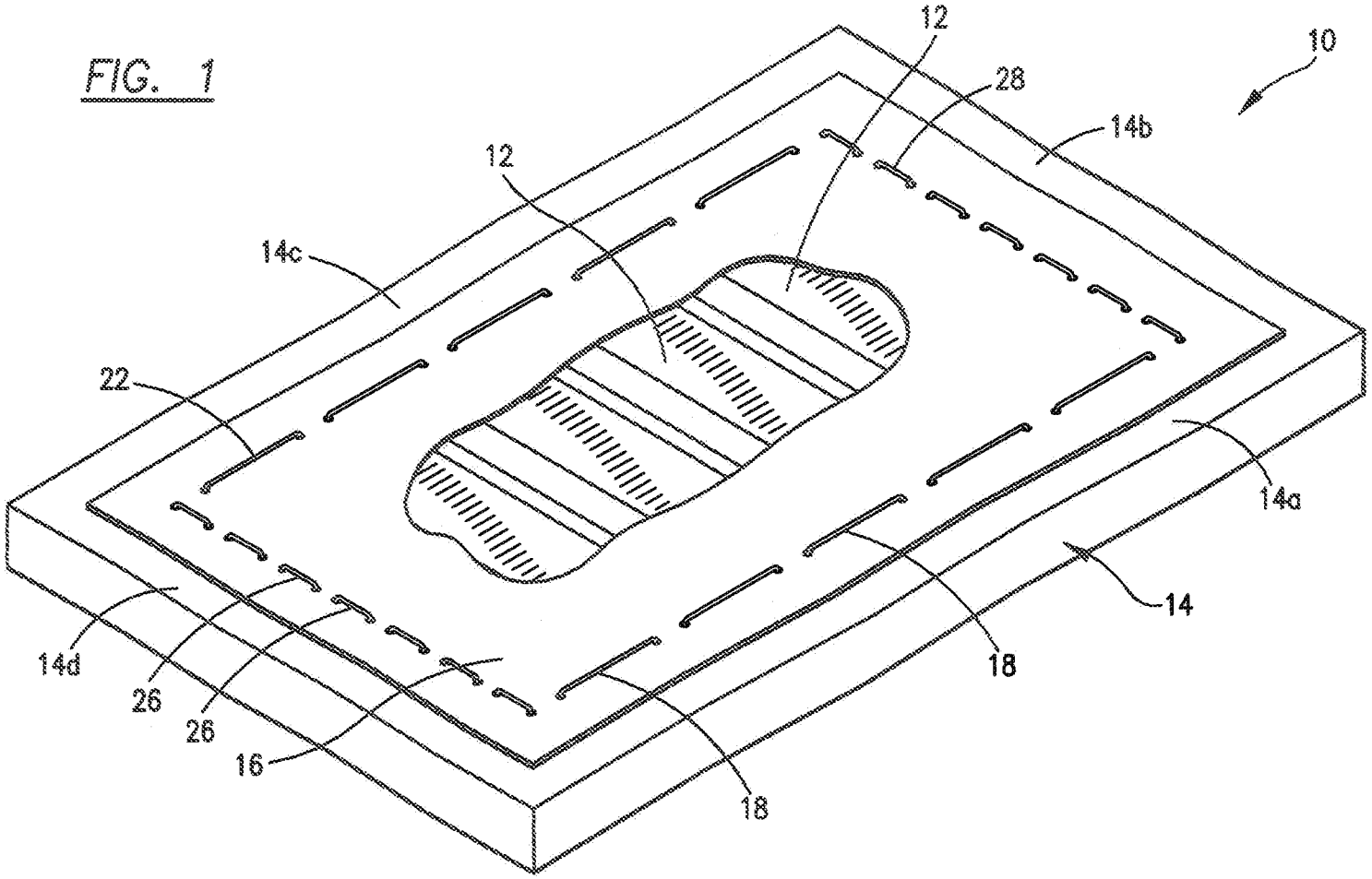
FIG. 1 shows a perspective view of the under mattress support constituting the invention partially cut away.

Referring now to the drawings and in particular FIG. 1, the under mattress support 10 is shown. The support 10 includes an array comprising a plurality of elongated polyurethane foam slats 12 arranged parallel to each other and spaced apart approximately 2-5 inches as shown. However slat separation between adjacent slats can be more or less than 2-5 inches if required by a specific mattress or box spring construction. The lateral cross-section of each slat 12 is substantially rectangular in shape. The length of each slat will depend on the particular size bed that the mattress support will be utilized on. The mattress support may be used on single or twin beds, double beds, queen-size beds, king size beds, and California king size beds. The length of each of the slats 12 is determined by the distance from one side of a mattress to the other side of the mattress. In the case of a single or twin bed, one under mattress support could be utilized. In the case of a full-double-queen and king size bed, two under mattress supports could be utilized, when two people occupy the bed.

Each of the foam slats 12 has a series of cords sewn into and out of areas of the slats 12 in order to hold the slats 12 together in a parallel array at each end of the slats. The cords also extend along the top side of each of the slats 12 near each end and the bottom side of the slats. As shown in FIG. 1, there are four separate cords 18, 22, 26 and 28 sewn into the ends and sides of the slat array. End cords 26 and 28 are sewn into different parallel foam slats of opposite ends of the device 10. Each of the cords can be made of any desired material such as fabric or artificial plastic as long as it is sufficiently strong to bind the foam slats 12 together in a supportive array.

Shown in FIG. 1 is a bottom cover 14 made of a fabric cloth such as cotton and which has overlapping top edges 14*a*, 14*b*, 14*c*, and 14*d*. A separate top cover 16 is shown. The top cover 16 is made of a quilter's batting material in order to contact the bottom surface of the mattress (not shown) to prevent mattress movement between the upper mattress and the lower box spring and the under mattress support that constitutes the invention. The cords 18, 22, 26 and 28 shown in FIG. 1 are also used to sew and attach the bottom cover 14 shown and the top cover 16 shown together. The foam slats 12, the bottom cotton cover 14, the top cover 16, and the cords 18, 22, 26 and 28 constitute the under mattress supporting device.

Figure 2:
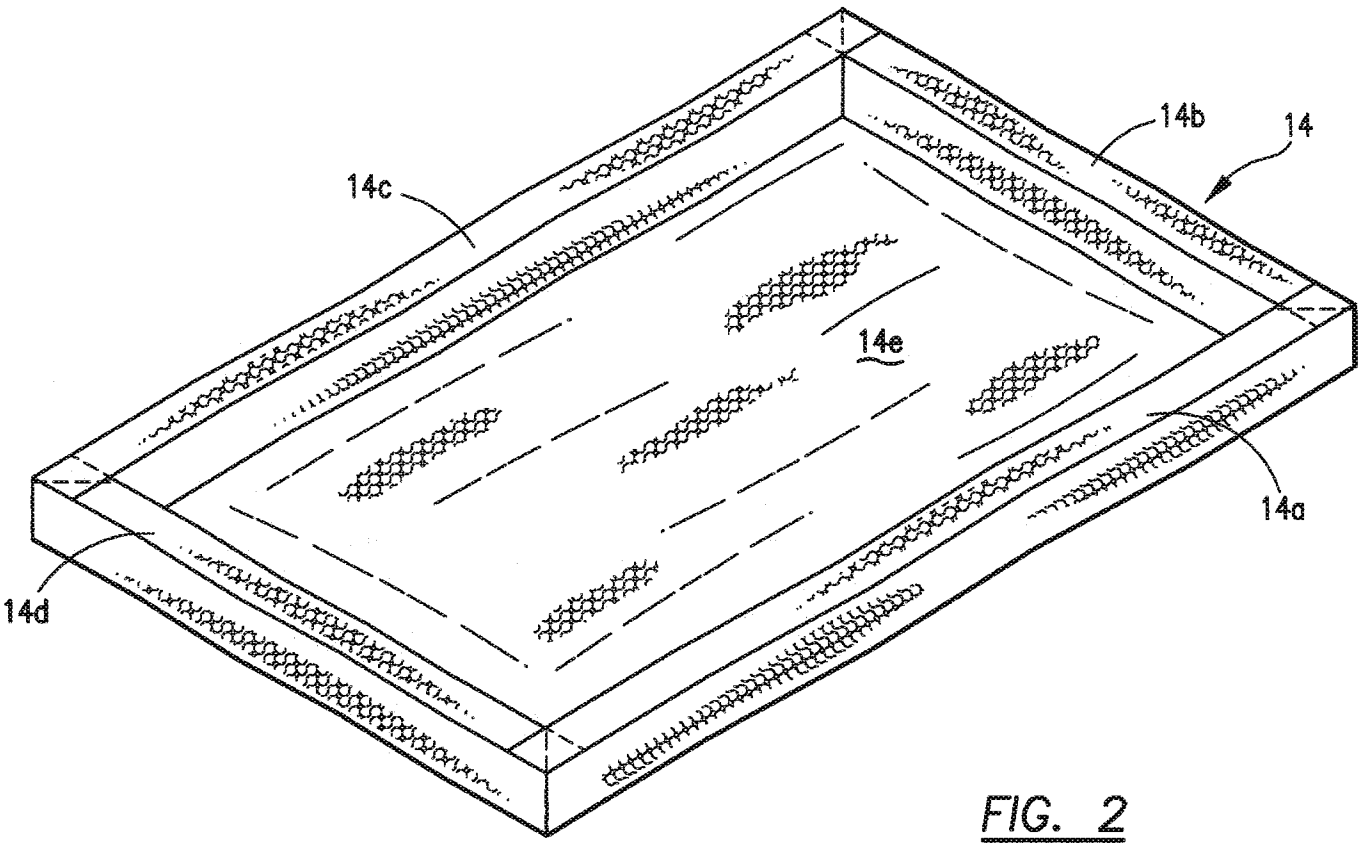
FIG. 2 shows a perspective view of the bottom cover of the mattress support.

Referring now to FIG. 2, the bottom cover 14 includes a bottom surface 14*e* and a plurality of overlapping top edges 14*a*, 14*b*, 14*c*, and 14*d*. These top edge surface areas of cover 14 engage top cover 16 shown in FIG. 3 such that cords can also be used to sew and fasten the bottom cover 14 shown in FIG. 2 to the top cover 16 shown in FIG. 3 to the foam slats 12 to keep the slats parallel and spaced apart. The bottom cover 14 is made from cotton or other suitable fabric.

Figure 3:
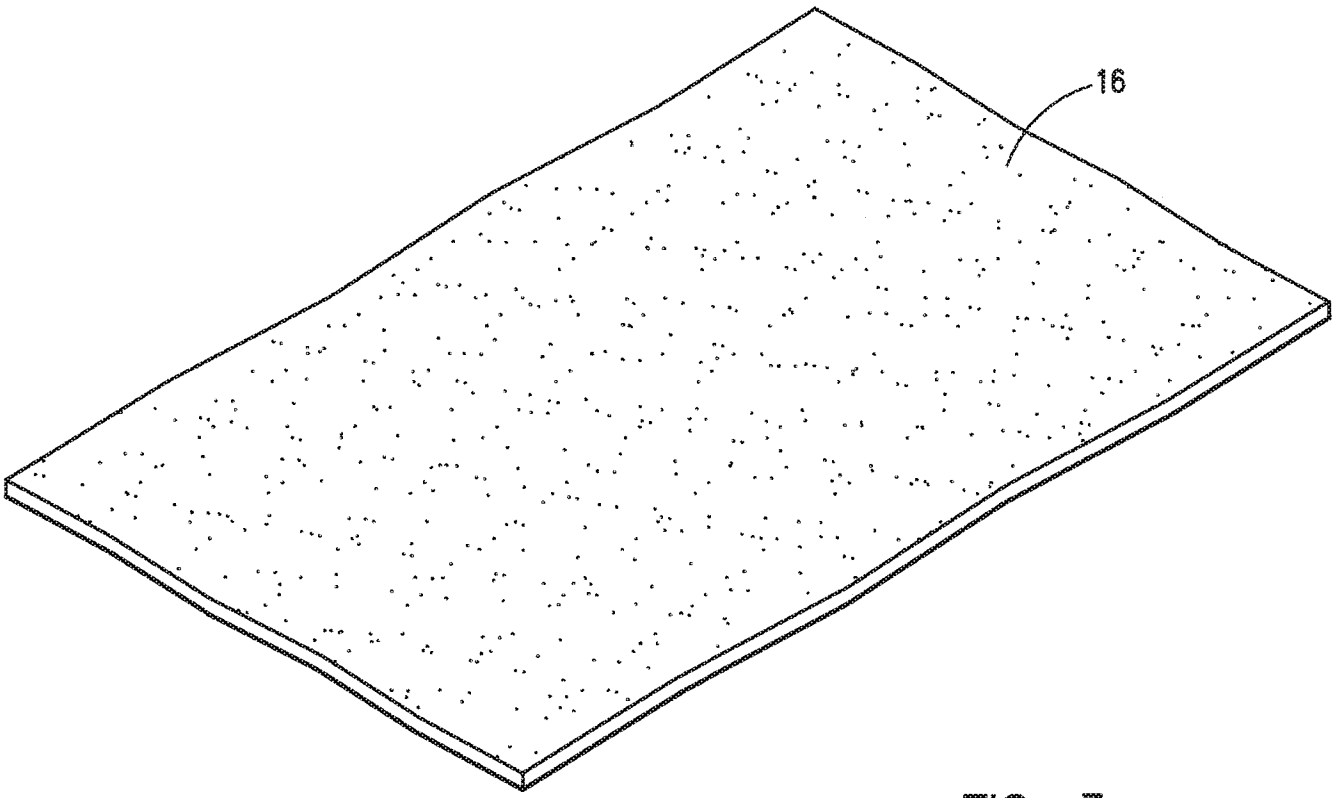
FIG. 3 shows a perspective view of the top cover of the mattress support.

FIG. 3 shows the top cover 16 which is made of quilter's batting so that the mattress (not shown) will not slide relative to the under mattress cover 10. The length and width of the top cover 16 is larger than the opening provided by the bottom cover 14 top edges as shown in FIG. 1. The top cover 16 is secured in place and fastened to the bottom cover top edges by the cords shown in FIG. 1 and to the foams slats 12 to hold the slats 12 fixed in place.

Figure 4:
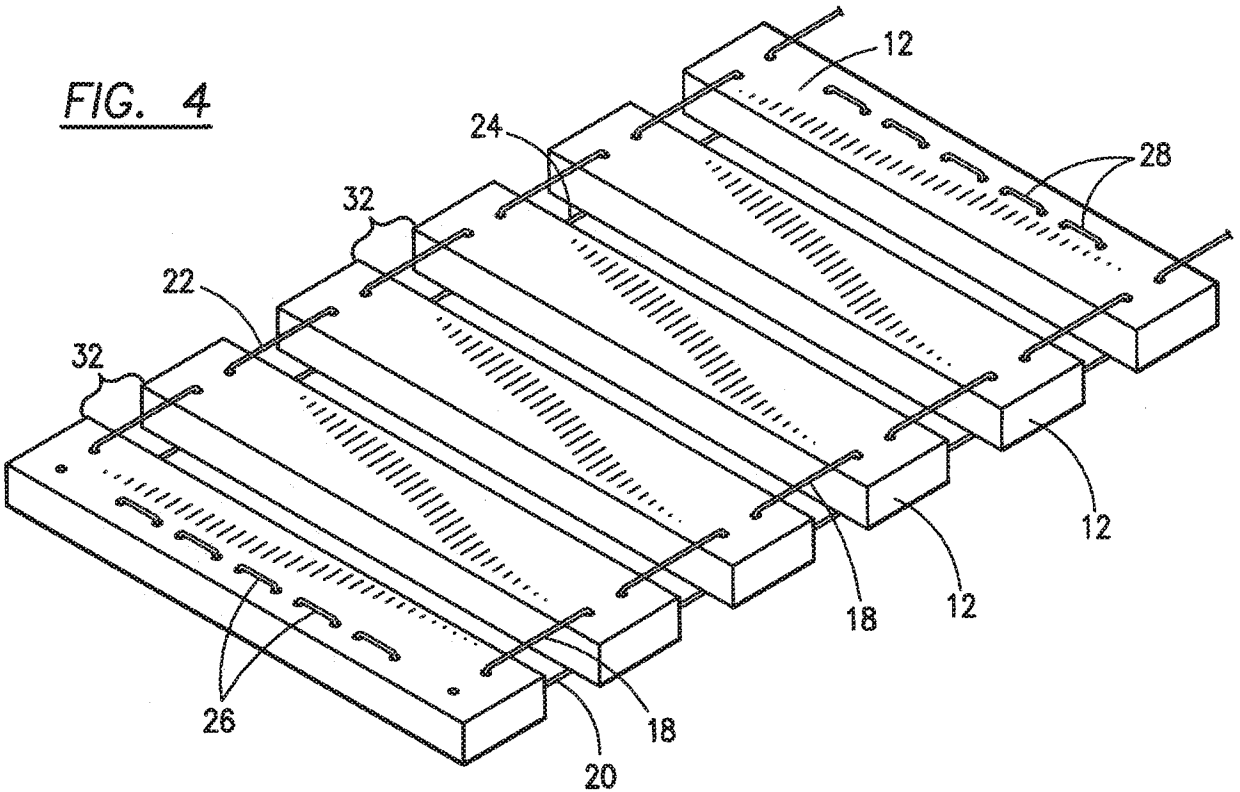
FIG. 4 shows a perspective view of the foam slats utilized in the mattress support.

FIG. 4 shows the array of foam slats 12 connected together by cords without the top cover 16 and the bottom cover 14 for illustrative purposes only. The foam slats 12 are spaced apart as shown by element 32 for preventing pressure spots along the mattress and for reducing heating. The cords 18 and 20 at one end of the slats and the cords 22 and 24 at the opposite ends of the slats 12 in conjunction with the cords 26 and 28 at top and bottom of the slat array provide a fastening of the entire array unit to the top and bottom covers 16 and 14 respectively as shown in FIG. 1.

Because of the flexibility of the fabric bottom cover 14 shown in FIG. 2 and the flexibility of the top cover 16 shown in FIG. 3, the primary support force provided by the under mattress support will be achieved from the parallel polyurethane foam slats 12. By providing a 2-5 inch spacing shown in between each slat 12, the mattress support 10 also can reduce heat buildup between the mattress and the box spring when in use. The slat 12 element spacing also allows for prevention of pressure points that may be caused by a unitary support structure since the slats are all spaced equally apart.

The orientation of the slats 12 is such that the length of the slats extends across a portion of the mattress from side to side. Thus the under mattress support size will be determined by the length of the slats 12 which will also be determined by the size bed and mattress to be supported. For use with a full-double-queen-size bed, two under mattress supports are used and are each 20 inches by 50 inches. Another under mattress support can be 31 inches by 50 inches which can be used with a single or twin bed or with two separate devices for a king size bed.

Tying or sewing each slat 12 to its adjacent slat 12 with strong cords 18 and 22 at opposite ends and cords 26 and 28 at the opposite sides of the under mattress support 10 provide a strong but non-complex method of securing the array of slats together in a parallel array and at the same time providing a non-complex solution to attaching the bottom cover 14 to the top cover 16. It is possible in another alternate embodiment that the bottom cover 14 shown in FIG. 2 and the top cover 16 shown in FIG. 3 could be physically attached by stitching them together and to the individual slats 12 through known sewing techniques.

Figure 5:
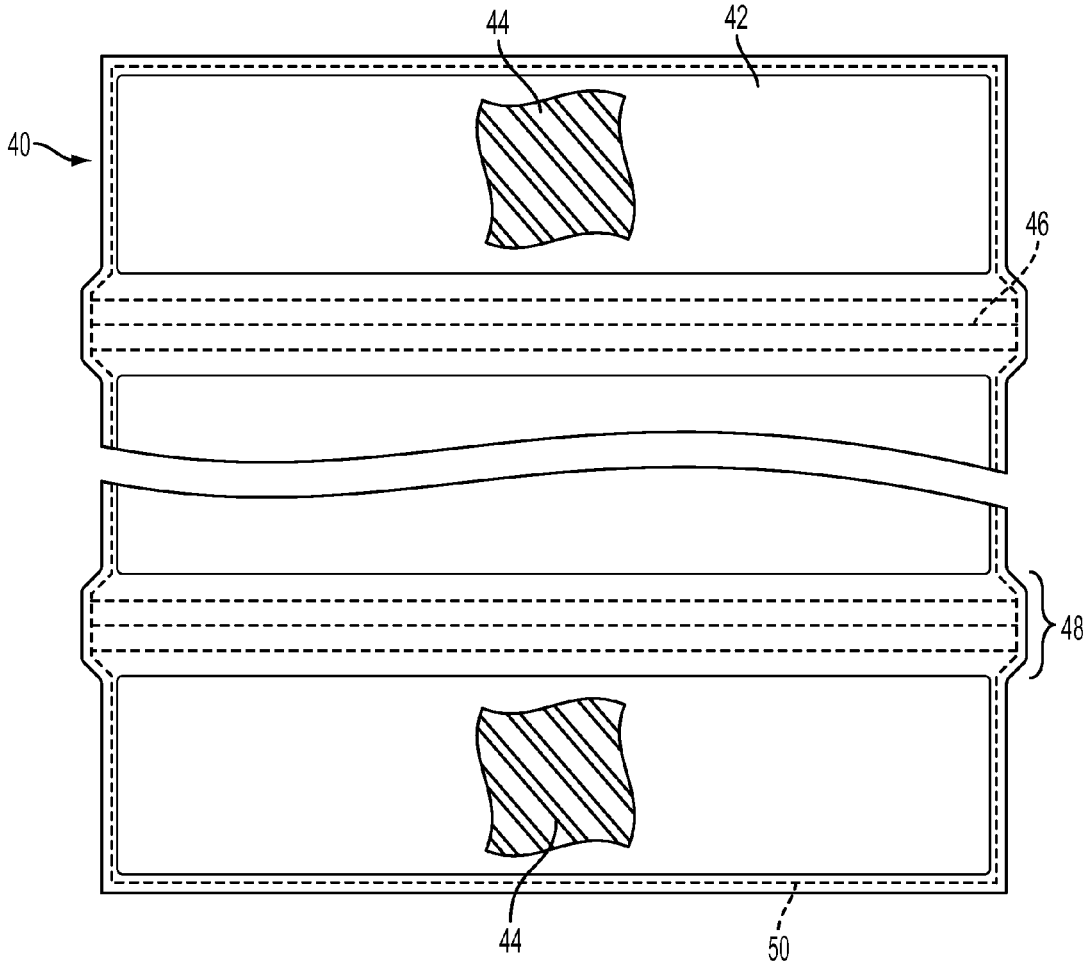
FIG. 5 is a top plan view of an alternate embodiment of the invention that is cut away for an indeterminate width which could also be done for the length.
Figure 6:
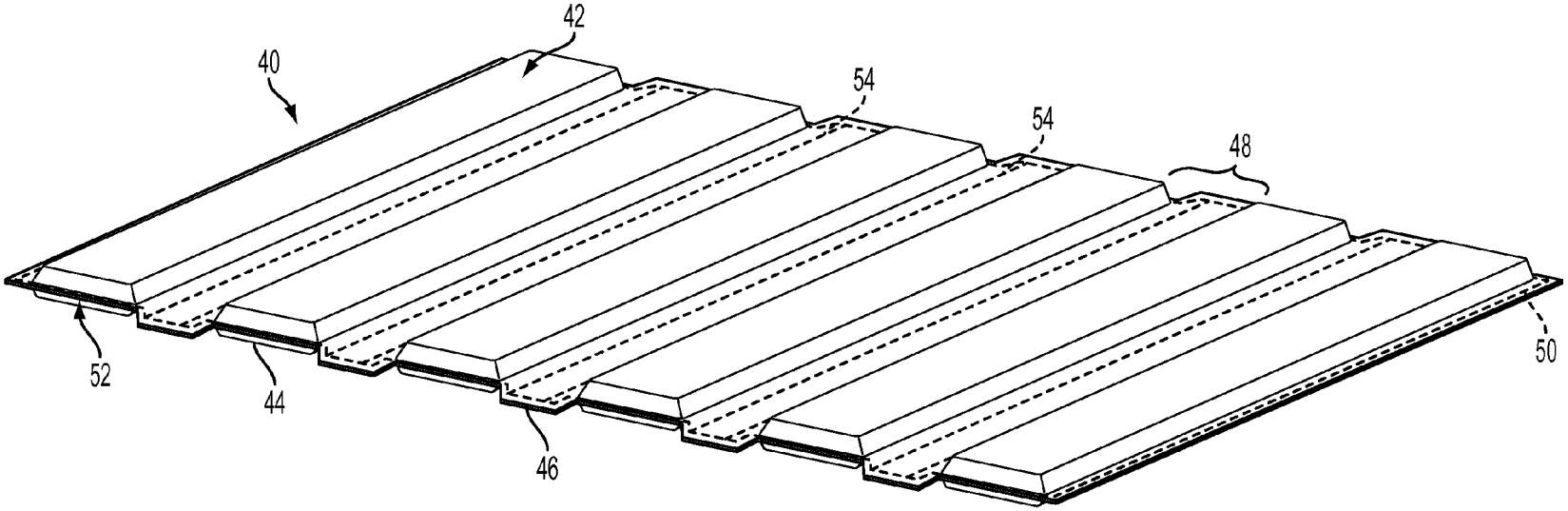
FIG. 6 is a perspective view of the alternate embodiment disclosed in FIG. 5.

FIGS. 5 and 6 show an alternate embodiment of the invention 40 in which the foam slats 44 are completely encased in fabric by sewing together a top fabric cover 42 and a bottom fabric cover 52. By stitching the top fabric cover 42 and the bottom fabric cover 52 together completely around each foam slat including the ends by threaded stitch 50 and creating a separate fabric strip 48 between each foam slat 44, an important separation is provided between each foam slat laterally which is essential for the best performance of the mattress support 40.

The fabric strip 48 which is accomplished by sewing stitching provides at least approximately 2 inches to 5 inches between the lateral sides of parallel disposed foam slats 44. Each fabric strip 48 includes multiple threaded stitches 46 and perimeter threaded stitch 50 that extends completely around the mattress support 40 joining the top fabric cover 42 to the bottom fabric cover 52. Additional stitches 54 are used to enclose the lateral edges of each of the foam slats 44. The fabric strip 48 is resilient to allow folding of the under mattress support for storage purposes. In one embodiment, the fabric used for the covers (top and bottom) may be a nonwoven material. The cover fabric may be made of a natural or synthetic pliable woven or nonwoven material. The cover material can also be made of a pliable cloth or fabric non-slip material.

The number of foam slats 44 can be varied depending on the length of the mattress to be supported. The length of the foam slats and the device can be any desired length, again depending upon the width of the mattress to be supported.

The polyurethane foam slats compression strength, measured longitudinally, will be sufficient to eliminate sagging areas or concave areas in a well-used or soft mattress without making the supported mattress uncomfortable. In one embodiment the heavy duty polyurethane foam slats may have a foam density of 1.5-1.8 and the heavy duty polyurethane foam slats may have a firmness of 35. Other foam densities and firmness values can be utilized. The foam slats 12 have some give and resiliency so that they do not act like rigid boards or rigid plastic which would otherwise make the supported mattress uncomfortable. In one embodiment each of the foam slats 12 would be between 2.5 inches to 8 inches in width, 1 inch to 4 inches in height, with the length determined by the mattress size in width. The polyurethane foam is selected to have a desirable compression force with some resiliency and durability for extended daily use. In using commercial polyurethane foam, the foam should be heavy duty polyurethane foam.

In the preferred embodiment, the heavy duty polyurethane foam slats are described as rectangular polyhedrons. It is feasible that the heavy duty polyurethane foam slats could be cylindrically shaped with a circular cross-section or elliptical cross-section provided the support characteristics remain.

The sizes of the under mattress supports can be (two) 20 inches by 50 inches for a full-double-queen size bed and 31 inches by 50 inches for a single bed or each twin bed or two separate devices 31 inches by 50 inches for a king-size bed, using two under mattress supports. Any other size is feasible as long as the mattress support can extend sufficiently in length and width between an existing mattress and an existing box spring to enhance the support of the mattress sufficiently. The slats made of polyurethane heavy-duty foam can be varied in dimensions including width and thickness dependent on the specific mattress to be supported. The spacing between the parallel slats on their lateral sides can also be varied as long as there is sufficient space to adequately allow the slats to compress laterally during support of a mattress.

The under mattress support disclosed herein is utilized by inserting the mattress support between the box spring and the sagging mattress to be supported. The lengths of the slats 12 are selected to extend from a portion of one side of the mattress to a portion of the other side of mattress. The total length of the under mattress support 10 from top to bottom can be such to cover the substantial portions of a human torso but should be at least 50 inches long or longer and positioned centrally from the top of the mattress to the bottom of the mattress.

The utilization of the invention described in here to the under mattress support can greatly prolong the life of a desirable but sagging or soft mattress and can restore the mattress to its original shape and comfort which the prior art does not seek to accomplish.

The length and width of the under mattress support described herein can be varied dependent upon the size of the mattress and box spring that the under mattress support is being used with. Typically each under mattress support will be no longer (top to bottom) than 84 inches accommodating nine foam slats laterally disposed. The width of the under mattress support would be typically no wider than 76 inches across, normally the width from side to side. The minimum amount of foam slats to be used is five slats. The maximum number of slats to be used is nine slats. The minimum spacing between slats is approximately 1 inch. The maximum spacing between the slats is 8 inches. The minimum depth or thickness of each foam slat is 1 inch. The maximum depth or thickness of each foam slat is 4 inches. The peripheral edges or sides of the mattress support could include a one inch serge along the peripheral border.

The instant invention has been shown and described herein in what is considered to be the most practical and preferred embodiments. It is recognized, however, that departures may be made therefrom within the scope of the invention and that obvious modifications will occur to a person skilled in the art.

What I claim is:

1. An under mattress support for positioning between a box spring support and a sagging area of an overlying mattress, the box spring support and overlying mattress having corresponding sides extending longitudinally between upper and lower ends of the respective box spring and mattress ends, the under mattress support comprising:

a series of parallel spaced-apart laterally extending elongated resilient unitary heavy duty polyurethane foam slats, each slat having a predetermined width and height, and a predetermined slat length adequate to extend laterally from a portion of one of the sides of the mattress to be supported to a portion of the opposite side of the mattress to be supported;

a unitary bottom pliable fabric cover disposed beneath the slats such that the bottom pliable fabric cover extends completely beneath all of said slats; and a top pliable fabric cover disposed above the slats such that the top pliable fabric cover extends completely above all of said slats, the top pliable fabric cover selectively fixedly attached to said bottom pliable fabric cover in a manner resulting in the permanent encasement of each of said foam slats within a corresponding unique slat enclosure such that each individual encased slat has a contiguous exterior surface completely surrounded by, and directly adjacent to, a corresponding contiguous interior surface of the corresponding unique slat enclosure, thereby completely permanently encasing each unitary polyurethane foam slat within a corresponding unique enclosure rendering the slat inaccessible, said selective attachment further comprising first and second laterally-extending linear cover attachment portions each permanently affixing the top and bottom fabric covers to one another along the length of the respective attachment portion, the cover attachment portions disposed in a predetermined desired spaced-apart relationship to one another within an area between adjacently positioned first and second enclosed slats having opposing corresponding first and second slat lateral sides, a first one of the attachment portions running adjacent to the first slat lateral side, and a second one of the attachment portions running adjacent to the second slat lateral side, forming a pliable fabric strip having a strip width of at least approximately one inch and having a fabric strip length greater than a corresponding length of each slat enclosure as measured from the opposite edges of adjoined top and bottom pliable fabric covers enclosing opposite ends of each polyurethane slat, such that opposite ends of each pliable fabric strip extend laterally outward beyond the corresponding opposite edges of the adjoined top and bottom pliable fabric covers enclosing the slat ends, wherein said formed pliable fabric strips enable and facilitate lateral compression of said under mattress support when the under mattress support is in use supporting said mattress, each said formed pliable fabric strip having adequate resiliency to enable selective folding of said under mattress support longitudinally along the respective lengths of said pliable fabric strips to enable the under mattress support to be easily folded or rolled up into a compact configuration, thereby facilitating compact packaging of said under mattress support prior to initial use, and subsequent compact storage of said under mattress support when not in use.

2. An under mattress support as recited in claim 1, wherein:

said pliable fabric strip separating each pair of adjacent enclosed foam slats has a strip width adequate to maintain a minimum spacing between said adjacent enclosed slats within a range of approximately 2 inches to 5 inches.

3. An under mattress support as recited in claim 1, wherein:

said top pliable fabric cover is selectively permanently attached to said bottom pliable fabric cover by stitching.

4. An under mattress support as recited in claim 1, wherein:

said top pliable fabric cover is selectively permanently attached to said bottom pliable fabric cover along each lateral side of each foam slat by stitching, forming an enclosure of the top pliable fabric cover and the bottom pliable fabric cover completely around each foam slat.

5. An under mattress support as recited in claim 4, wherein:

each of said plurality of pliable fabric strips extends laterally from the attachment of said top pliable fabric cover to said bottom pliable fabric cover along each lateral side of each foam slat such that each pair of adjacent foam slats are parallel to one another and spaced apart from one another a predetermined distance to allow lateral compression of each foam slat when the mattress support is properly placed interposed between said mattress and said box spring during use.

6. An under mattress support as recited in claim 5, wherein each slat further comprises:

a rectangular six-sided polyhedron slat having a height within a range of 1 inch to 4 inches and a width within a range of 2.5 inches to 8 inches.

7. An under mattress support as recited in claim 6, wherein:

each polyhedron slat is constructed of polyurethane foam having a foam density within a range of 1.5 to 1.8 pounds per cubic foot.

8. An under mattress support as recited in claim 5, wherein:

each of said plurality of pliable fabric strips provides slat lateral spacing having a distance within a range of 1 inch to 8 inches.

9. An under mattress support for deployment between a mattress and a box spring, the under mattress support comprising:

a plurality of unitary elongated heavy duty polyurethane foam slats, each slat having a rectangular polyhedron geometric shape at least partially defined by a pair of opposite lateral sides extending between upper and lower slat ends;

a non-woven material cover completely wrapped around each foam slat, said non-woven material cover thereby completely enclosing said slat such that each heavy duty polyurethane foam slat is permanently encased within a corresponding non-woven material covering rendering each foam slat inaccessible, each slat enclosure having a lateral length measured from an edge of said non-woven material cover disposed about a first end of said slat and an opposite edge of said non-woven material cover disposed about an opposite second end of said slat; and a plurality of elongated non-woven strips each having a width defined by a distance between opposite first and second lateral strip sides and a length defined by a lateral distance between opposite edges of said strip, the lateral length of said strips greater than the corresponding lateral length of said slat enclosures such that the edges of said strips extend laterally outward beyond the corresponding opposite edges of said slat enclosures, the first lateral strip side permanently affixed to a portion of covering overlying a lateral side of a first one of said encased foam slats, and the second lateral strip side permanently affixed to a portion of covering overlaying a lateral side of an adjacent second one of said encased foam slats thereby forming an array of covered parallel foam slats, each pair of covered adjacent parallel foam slats spaced apart from one another a predetermined distance defined by the width of the non-woven material strip to provide spacing between the foam slats when the under mattress support is in operation to provide lateral compression on each slat for lateral expansion to enhance support of a portion of said mattress overlying said under mattress support.

10. An under mattress support as recited in claim 9, wherein:

said slat cover is constructed from a pliable non-woven material fabric.

11. An under mattress support as recited in claim 9, wherein:

said slat cover is constructed from a pliable nonslip material.

12. An under mattress support as recited in claim 9, further comprising:

a top cover constructed of quilter's batting material so that the mattress to be supported will not slide relative to the under mattress support.

* * * * *